US010542832B2

(12) United States Patent
Marciano

(10) Patent No.: US 10,542,832 B2
(45) Date of Patent: Jan. 28, 2020

(54) FOOD SERVING PLATE SYSTEMS

(71) Applicant: Michelle Marciano, Far Rockaway, NY (US)

(72) Inventor: Michelle Marciano, Far Rockaway, NY (US)

( * ) Notice: Subject to any disclaimer, the term of this patent is extended or adjusted under 35 U.S.C. 154(b) by 15 days.

(21) Appl. No.: 15/922,635

(22) Filed: Mar. 15, 2018

(65) Prior Publication Data

US 2019/0282009 A1 Sep. 19, 2019

(51) Int. Cl.
*A47G 19/02* (2006.01)
*B65D 55/14* (2006.01)

(52) U.S. Cl.
CPC ..... *A47G 19/025* (2013.01)

(58) Field of Classification Search
CPC ..... A47G 19/025
USPC .... 220/575, 574.2, 574, 526, 525, 524, 556, 220/210
See application file for complete search history.

(56) References Cited

U.S. PATENT DOCUMENTS 2,011,996 A 8/1935 Belk
3,305,124 A 2/1967 Whiteford
3,545,642 A * 12/1970 Swett ..... A47G 23/06 206/203
3,845,875 A 11/1974 Douglas et al.
4,081,646 A 3/1978 Goltsos
4,175,672 A * 11/1979 Moser ..... E05C 19/002 220/524
RE30,962 E 6/1982 Bridges
4,420,678 A 12/1983 Kalb
4,693,371 A 9/1987 Malpass
5,016,756 A 5/1991 Wischhusen et al.
D321,788 S * 11/1991 Chen ..... 220/524
5,094,355 A 3/1992 Clark et al.
5,371,846 A * 12/1994 Bates ..... G06F 3/04855 345/684
5,716,657 A 2/1998 Liebermann
5,782,359 A * 7/1998 McAllister ..... B65D 41/06 206/1.5
6,065,595 A 5/2000 Ratcliff
(Continued)

OTHER PUBLICATIONS

Fred & Friends Dinner Winner Supper Hero Tray; accessed Jan. 18, 2018 (2 pages); available at: https://m.bedbathandbeyond.com/m/product/fred-friends-reg-dinner-winner-supper-hero-tray/1060181350?skuId=60181350&mcid=PS_googlepla_nonbrand_baby_&product_id=60181350&adtype=pla&product_channel=online&adpos=1o2&creative=43742623309&device=m&matchtype=&network=g&gclid=CMyU3_6e0tQCFcSLswod7fQAWA.
(Continued)

*Primary Examiner* — J. Gregory Pickett
*Assistant Examiner* — Niki M Eloshway
(74) *Attorney, Agent, or Firm* — Locke Lord, LLP; Judy R. Naqmat; Alicia J. Carroll

(57) ABSTRACT

A food serving system includes a top serving portion and a bottom serving portion removably nested under the top serving portion. The bottom serving portion includes a closeable compartment with a door operatively connected to the closeable compartment to optionally occlude and unocclude an opening of the closeable compartment. A food serving system includes a serving tray including a top serving portion and a bottom serving portion. The bottom serving portion includes a closeable compartment with a door operatively connected to the closeable compartment to optionally occlude and unocclude an opening of the closeable compartment. The top serving portion is formed within the door of the bottom serving portion.

20 Claims, 3 Drawing Sheets

(56) References Cited

U.S. PATENT DOCUMENTS

| | | | | |
|---|---|---|---|---|
| 6,347,716 | B1 * | 2/2002 | Nofer | B65D 47/0804 215/235 |
| 6,352,151 | B1 | 3/2002 | Stewart | |
| 6,352,258 | B1 * | 3/2002 | Fitzgerald | A47G 19/025 273/138.1 |
| 6,752,288 | B1 | 6/2004 | Swift | |
| 7,735,651 | B2 * | 6/2010 | Shew | B65D 1/36 206/541 |
| 7,832,586 | B2 | 11/2010 | Vovan | |
| 8,006,860 | B2 * | 8/2011 | Klein | B65D 77/044 206/800 |
| 8,083,090 | B2 | 12/2011 | Cocchiarella | |
| 8,505,768 | B2 | 8/2013 | Bardwell et al. | |
| 9,414,701 | B1 | 8/2016 | Yen et al. | |
| 2011/0056976 | A1 * | 3/2011 | Chen | B65D 43/162 220/833 |
| 2011/0240653 | A1 * | 10/2011 | Castner | A45C 11/20 220/526 |
| 2015/0108123 | A1 * | 4/2015 | Linehan | A47D 3/00 220/17.1 |
| 2015/0289689 | A1 | 10/2015 | Verdirame | |
| 2016/0113444 | A1 * | 4/2016 | Butler | A47J 39/006 219/387 |

OTHER PUBLICATIONS

PlayMeal Kid's Adventure Food Bowl; accessed Jan. 18, 2018 (8 pages); available at: https://www.amazon.com/PlayMeal-Adventure-Mealtime-Motivates-Surprise/dp/B01MYRMILR/ref=redir_mobile_desktop?_encoding=UTF8&dpID=414onAdBv9L&dpPI=1&keywords=playmeal&qid=1513274099&ref=plSrch&ref_=mp_s_a_1_1_a_it&sr=8-1&th=1.

Prodyne AB-5-L Appetizers-On-Ice with Lids; accessed Aug. 23, 2017 (7 pages); available at: https://www.amazon.com/Prodyne-AB-5-L-Appetizers-On-Ice-with-Lids/dp/B000UMK9QS/ref=pd_bxgy_79_img_2?_encoding=UTF8&psc=1&refRID=026MBD6Z68ZYS8ZX4S8H.

* cited by examiner

Fig. 2B
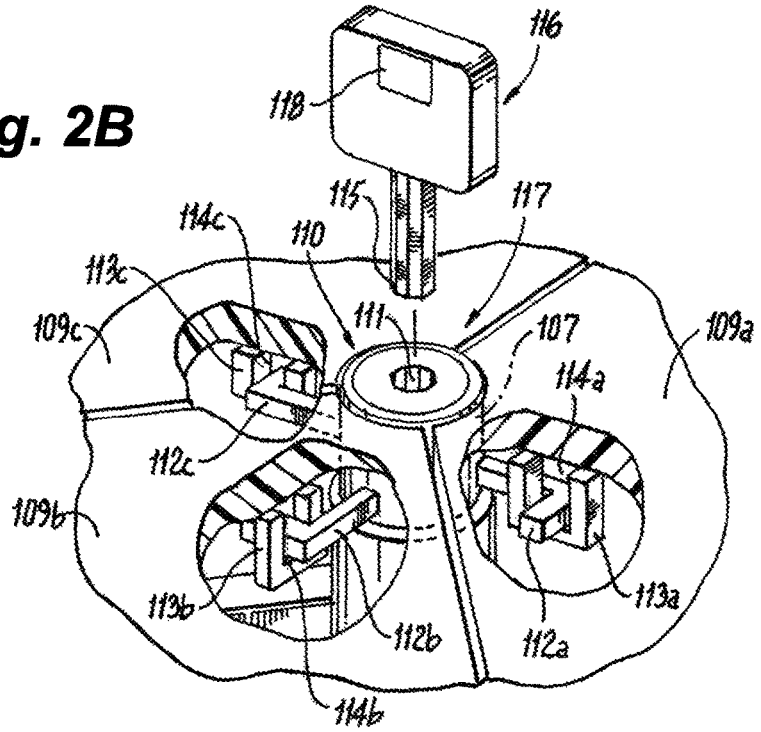
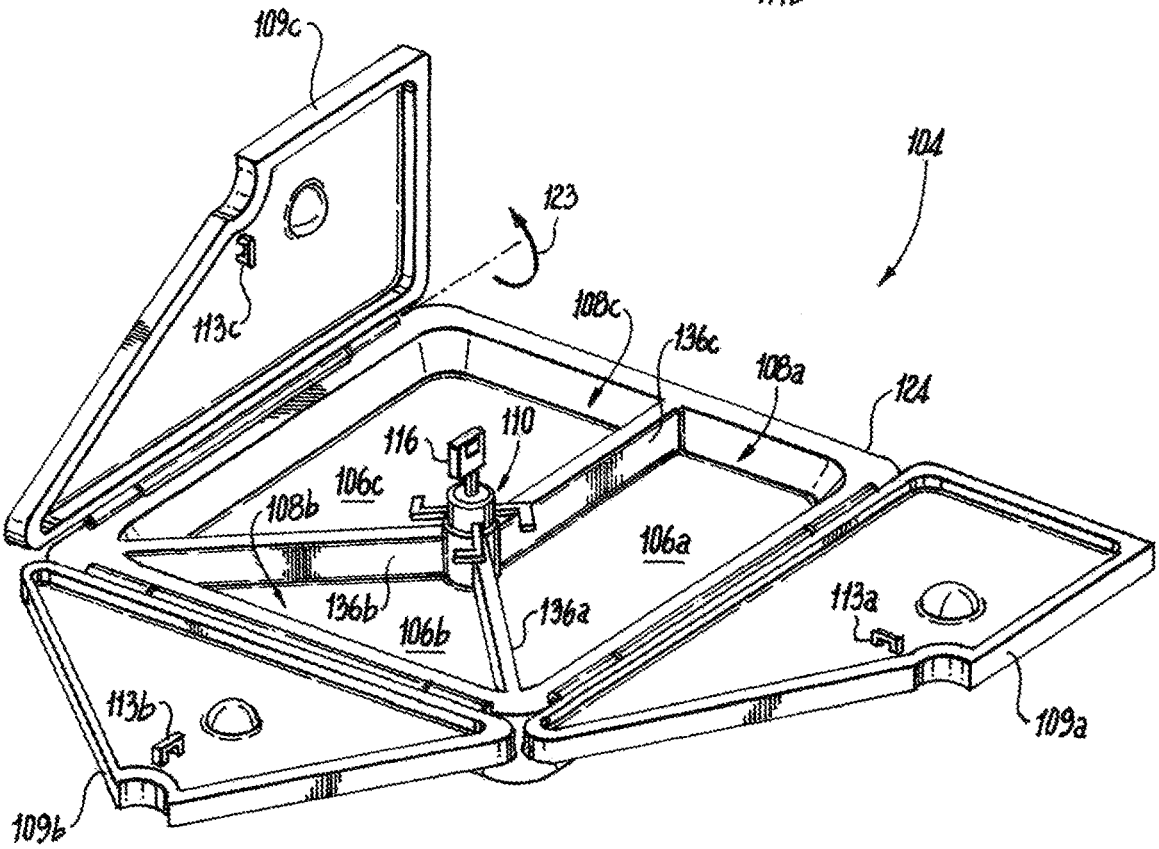
Fig. 3

FOOD SERVING PLATE SYSTEMS

BACKGROUND OF THE INVENTION

1. Field of the Invention

The subject invention is directed to serving plate systems, and more particularly, to serving plate systems that incorporate features to encourage users to eat food served on a top portion of the plate system to obtain access to a bottom portion of the plate system.

2. Background of the Related Art

Serving plate systems, such as those used for serving food to children, traditionally include a single plate with one or more compartments or wells for containing the food. In some plates, one or more of the compartments is shaped as part of a design. The perimeters of the plates themselves are also sometimes shaped in a unique way. The plates may also include graphics or illustrations to make the food and mealtime more appealable to children. While shapes and designs provide interest, traditional serving plate systems do not provide for the engagement of children through incentives that encourage that child's interest in eating their food.

Thus, there is a need for serving plate systems having design elements, such as incentive features which are reliable, and easy to operate, make, use and clean. Accordingly, the present invention is directed to serving plate systems that meets these needs.

SUMMARY OF THE INVENTION

A food serving system includes a top serving portion and a bottom serving portion removably nested under the top serving portion. The bottom serving portion includes a closeable compartment with a door operatively connected to the closeable compartment to optionally occlude and unocclude an opening of the closeable compartment.

The system can include a locking mechanism mounted to the bottom serving portion to retain the door on the compartment opening. The locking mechanism can include an arm, wherein the arm can mate with an aperture on the door to lock the door to the closeable compartment. The locking mechanism can include a rotatable column with a locking aperture defined therein. The arm can extend radially outward from a periphery of the rotatable column for common rotation therewith. The system can include a key configured and adapted to rotate the arm to release or engage the arm with the aperture on the door. The key can include a magnet portion. The magnet portion on the key can be configured and adapted to magnetically couple with a portion of the arm through a thickness of the door. The door can include a downwardly extending tab having an aperture.

In some embodiments, the top serving portion includes a sidewall defining a perimeter of the top serving portion. The top serving portion can include a top compartment defined within the sidewall. The top compartment can have an opening and a floor surface opposite from the opening. The floor surface is recessed with respect to a top edge of the sidewall. The sidewall can extend in a downward direction from the top edge such that a height of the sidewall is greater than a depth of the top compartment. The compartment opening of the closeable compartment can face the bottom of the top serving portion when nested therein. The door can include an indent to provide assistance to a user to open the door.

The closeable compartment of the bottom serving portion can be one of a plurality of closeable compartments. The door can be one of a plurality of doors. Each of the plurality of doors can be operatively connected to a respective one of the plurality of closeable compartments. The closeable compartment of the bottom serving portion can be one of three closeable compartments. The three closeable compartments of the bottom serving portion can be separated by three partitions. Each partition can extend toward an outer perimeter of the bottom serving portion from a common central location. The door can be one of three doors. The locking mechanism can be mounted to the bottom serving portion at a junction of the three partitions and can include three spaced apart aims. Each arm can mate with a respective aperture on a respective one of the three doors to lock the door to the closeable compartment.

A food serving kit includes a top serving portion and a bottom serving portion configured and adapted to be removably nested under the top serving portion. The bottom serving portion includes a closeable compartment and a door operatively connected to the closeable compartment to optionally occlude and unocclude an opening of the closeable compartment. The kit includes a key configured and adapted to release and/or engage the door with the bottom serving portion.

In accordance with another aspect, a food serving system includes a serving tray including a top serving portion and a bottom serving portion. The bottom serving portion includes a closeable compartment with a door operatively connected to the closeable compartment to optionally occlude and unocclude an opening of the closeable compartment. The top serving portion is formed within the door of the bottom serving portion.

It should be appreciated that the present invention can be implemented and utilized in numerous ways, including without limitation as a process, an apparatus, a system, a device, and a method for applications now known and later developed. These and other unique features of the system disclosed herein will become more readily apparent from the following description and the accompanying drawings.

BRIEF DESCRIPTION OF THE DRAWINGS

So that those having ordinary skill in the art to which the disclosed system appertains will more readily understand how to make and use the same, reference may be had to the drawings wherein:

FIG. 2B is an enlarged perspective view of a portion of FIG. 2A, showing the locking mechanism and the key associated therewith;

FIG. 3 is a perspective view of the bottom serving portion of the food serving system of FIG. 1, showing the doors of the bottom serving portioning unlocked and in an open position.

Figure 1:
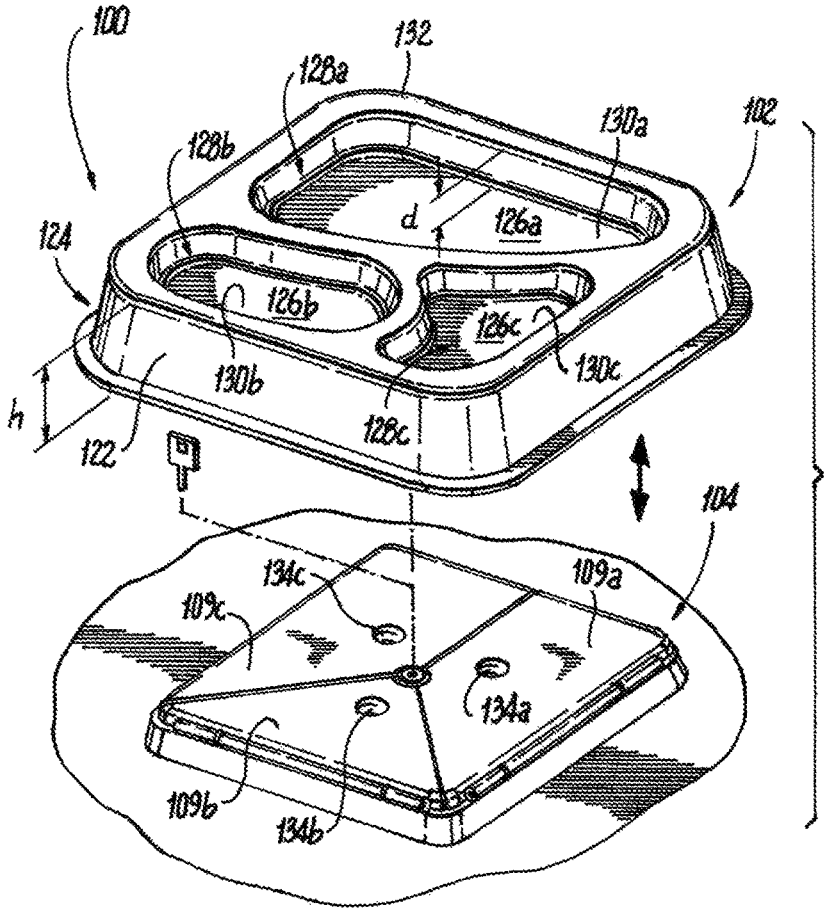
FIG. 1 is a perspective exploded view of an exemplary embodiment of a food serving system constructed in accordance with an embodiment of the present disclosure, showing the bottom serving portion and the top serving portion.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment

DETAILED DESCRIPTION OF PREFERRED EMBODIMENTS

Disclosed herein are detailed descriptions of specific embodiments of containers for protecting baked goods during shipment and methods of constructing the same. It will be understood that the disclosed embodiments are merely examples of the way in which certain aspects of the invention can be implemented and do not represent an exhaustive list of all of the ways the invention may be embodied. Indeed, it will be understood that the systems, devices and methods described herein may be embodied in various and alternative forms. Moreover, the figures are not necessarily to scale and some features may be exaggerated or minimized to show details of particular components.

Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Unless otherwise apparent, or stated, directional references, such as "right," "left," "upper," "lower," "outward," "inward," etc., are intended to be relative to the orientation of a particular embodiment of the invention as shown in the first numbered view of that embodiment. In addition, a given reference numeral indicates the same or similar structure when it appears in different figures and like reference numerals identify similar structural elements and/or features of the subject invention.

The present disclosure now will be described more fully, but not all embodiments of the disclosure are necessarily shown. In addition, many modifications may be made to adapt a particular situation or material to the teachings of the disclosure without departing from the essential scope thereof.

Figure 2A:
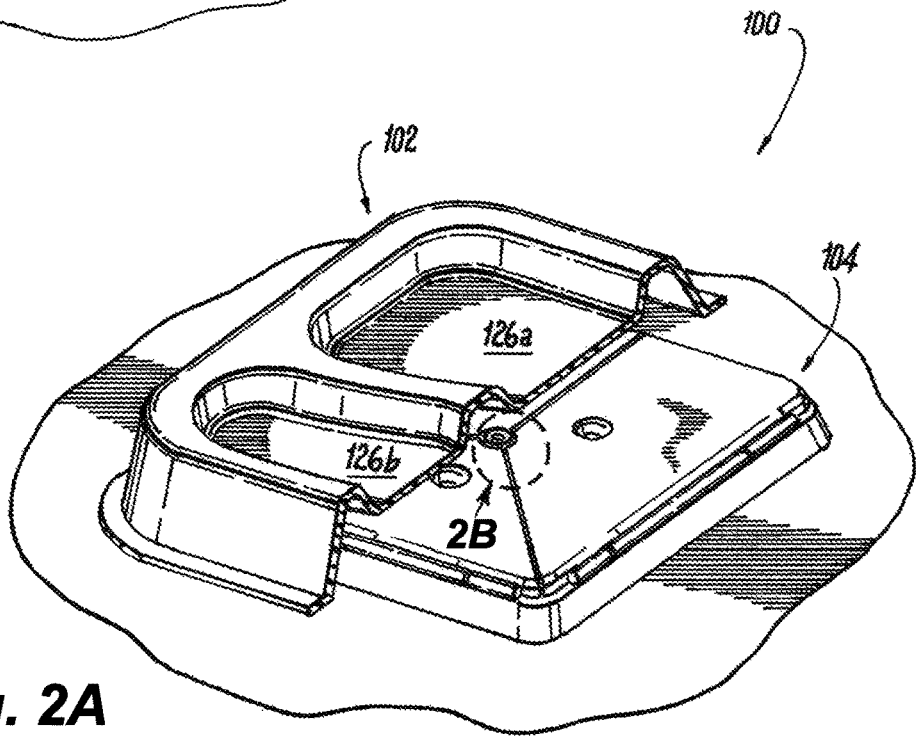
FIG. 2A is a partial cross-sectional perspective view of the food serving system of FIG. 1, showing the doors of the bottom serving portioning a closed position.

As shown in FIGS. 1-2A, a food serving system 100 includes a top serving portion 102 and a bottom serving portion 104 removably nested under top serving portion 102. Bottom serving portion 104 includes a plurality of doors 109*a*-109*c*. Each door 109*a*-109*c* includes an indent 134*a*-134*c* to provide assistance to a user to open door. Optionally, doors 109*a*-109*c* can, in lieu of or in addition to indents, have a magnetic portion or be made of metal. A key, described in more detail below, can have a magnetic piece that, when placed upon the door, can lift the door to open. Top serving portion 102 includes a sidewall 122 defining an outer perimeter 124 of top serving portion 102. Top serving portion 102 includes top compartments 126*a*-126*c* defined within sidewall 122. Top compartments 126*a*-126*c* each have respective openings 128*a*-128*c* and respective floor surfaces 130*a*-130*c* opposite from respective openings 128*a*-128*c*. Floor surfaces 130*a*-130*b* are recessed with respect to a top edge 132 of sidewall 122. Sidewall 122 extends in a downward direction from top edge 132 such that a height h of sidewall 122 is greater than a depth d of compartments 126*a*-126*c*. Compartment openings 108*a*-108*c* face the bottom of top serving portion 102 when bottom serving portion 104 is nested therein. Because top compartments 126*a*-126*c* are separated from another, a number of different types of foods can be served without the foods mixing, which can be important when being used with picky eaters, such as children.

As shown in FIG. 3, bottom serving portion 104 includes a plurality of closeable compartments 106*a*-106*c*. Each door 109*a*-109*c* is operatively connected to a respective one of closeable compartments 106*a*-106*c* to optionally occlude and unocclude a respective opening 108*a*-108*c* of each of closeable compartments 106*a*-106*c*. This can be achieved by having doors 109*a*-109*c* rotate about respective hinges toward and/or away from their respective closeable compartments 106*a*-106*c*, e.g. as schematically shown by the arrow 123. Those skilled in the art that the hinges can be a variety of mechanical hinges. Three closeable compartments 106*a*-106*b* of bottom serving portion 104, shown in FIG. 1, are separated by three partitions 136*a*-136*c*. Each partition 136*a*-136*c* extends toward an outer perimeter 124 of bottom serving portion 104 from a common central location. It is contemplated that in order to encourage and incentivize children to eat their food, a user of plate system 100 can use bottom serving portion 104 as a 'treasure chest' to reward the child for trying and/or finishing food in top storage portion 102. The doors 109*a*-109*c* limit and/or resist unauthorized access to the compartments 106*a*-106*c* of the 'treasure chest'. A locking mechanism, described below, adds further security to resist unauthorized access. The multiple, divided and separately openable/closeable compartments 106*a*-106*b* allow for additional motivation tactics to encourage eating. For example, multiple compartments allow multiple "treasures" to be stored at the same time while still being separate. Additionally, multiple compartments in bottom portion 104, e.g. the "treasure chest," allow for a single compartment to hold a motivator item (e.g. a toy or other food), while the others may hold nothing, prompting an interactive search game (e.g. which one is the prize in?).

With reference now to FIG. 2B-3, system 100 includes a locking mechanism 110 mounted to bottom serving portion 104 to retain doors 109*a*-109*c* on their respective compartment openings 108*a*-108*c*. Locking mechanism 110 is mounted to bottom serving portion 104 at a junction 117 of three partitions 136*a*-136*c*. Locking mechanism 110 includes a rotatable column 107 with a locking aperture 111 defined therein. The locking aperture 111 has a hexagonal-shaped perimeter such that the rotatable column 107 rotates about its longitudinal axis when a mating key 116, e.g. an allen-style key, is inserted and rotated. Key 116 includes an end 115 having a hexagonal cross-section that mates with hexagonal-shaped locking aperture 111. While locking aperture 111 and key 116 are described as having hexagonal female and male mating parts, a variety of mechanical lock-key combinations may be used. Locking mechanism 110 includes three circumferentially spaced apart aims 112*a*-112*c*. The arms 112*a*-112*c* extend radially outward from a periphery of the rotatable column 107 for common rotation therewith. Doors 109*a*-109*c* includes a downwardly extending tabs 113*a*-113*c* having respective apertures 114*a*-114*c*. Each arm 112*a*-112*c* mates with a respective aperture 114*a*-114*c* on a respective one of three doors 109*a*-109*c* to lock doors 109*a*-109*c* to the closeable compartment 106. It is contemplated that one or more arm 112*a*-112*c* can include an arcuate or cammed surface to ease insertion and removal of arms 112*a*-112 from their respective apertures 114*a*-114*c*, e.g. on the bend of arms 112*a*-112*c*. When the corresponding key 116 is inserted into locking aperture 111, the rotatable column 107 can be rotated and the arms 112*a*-112*c* are released from their respective apertures 114*a*-114*c*, allowing doors 109*a*-109*c* to be rotated and raised.

As shown in FIGS. 2A-3, key 116 of system 100 is configured and adapted to rotate arms 112*a*-112*c* to release or engage a given arm 112*a*-112*c* with its respective aperture 114*a*-114*c*. Key 116 includes a magnet portion 118. In accordance with some embodiments, e.g. systems without a locking aperture 111, magnet portion 118 on key 116 is configured and adapted to magnetically couple with a portion of locking mechanism 110 through a thickness of doors 109*a*-109*c* when doors 109*a*-109*c* are covering over compartments 106*a*-106*c* to rotate arms 112*a*-112*c* in/out of their respective locking apertures 114*a*-114*c* to allow the doors 109*a*-109*c* to be unlocked and opened, or locked and kept closed. As shown in FIG. 2B, it is also contemplated that key 116 includes both end 115 having a hexagonal cross-section and a magnetic portion 118. In that case, a user can use magnetic portion 118 to lift doors 109*a*-109*c* instead of, or in addition to, using recessed portions 134*a*-134*c*. It is contemplated that arms 112*a*-112*c* can be staged such that rotation of key 116 does not open all three doors 109*a*-109*c* at once.

The locking mechanism 110 inhibits the eater, e.g. the child, from gaining access to the "treasure chest" until an eating goal is met. Once the eating goal is met, key 116 is used by the eater, or a person supervising the eater, for example, to open the locking mechanism 110 by releasing one or more of the aims 112 from their respective apertures 114 allowing one or more of doors 109*a*-109*c* to be opened. The act of unlocking the "treasure chest" also serves as a fun game in and of itself, allowing the system 100 to be more exciting to the eater and therefore, also serves as a motivator outside of what is in the bottom serving portion 104. A food serving kit includes a top serving portion, e.g. top serving portion 102, and a bottom serving portion, e.g. bottom serving portion 104, as described above. The kit includes a key, e.g. key 116, configured and adapted to release and/or engage the door with the bottom serving portion 104. It is also contemplated that in lieu of or in addition to, top and bottom food serving portions 102, 104, respectively, and key 116, food serving system 200 can be used in the kit.

Figure 4:
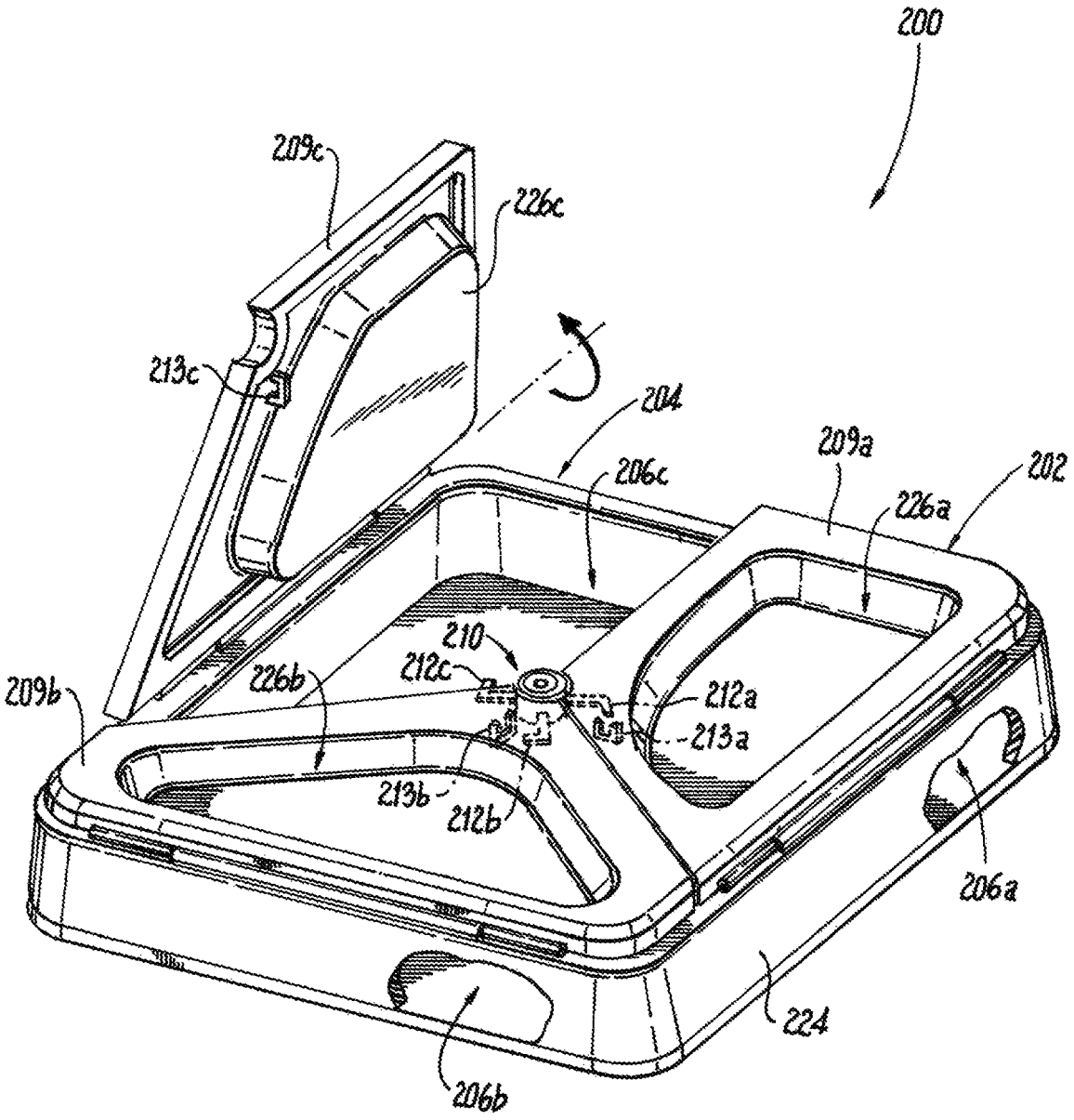
FIG. 4 is a perspective view of another exemplary embodiment of a food serving system constructed in accordance with an embodiment of the present disclosure, showing the top serving portion integrated within the doors of the bottom serving portion.

As shown in FIG. 4, in some embodiments a food serving system 200 includes a top serving portion integrated within a bottom serving portion. Food serving system 200 is similar to the bottom serving portion 104, except instead of substantially planar doors 109*a*-109*c*, system 200 includes doors 209*a*-209*c* having recessed compartments 226*a*-226*c* formed therein, similar to the top serving portion 102. As such, instead of having a separate top serving portion, e.g. top serving portion 102, recessed compartments 226*a*-226*c* in doors 209*a*-209*c* may be considered a top serving portion 202.

As shown in FIG. 4, a bottom serving portion 204 includes a plurality of closeable compartments 206*a*-206*c*. Each door 209*a*-209*c* is operatively connected to a respective one of closeable compartments 206*a*-206*c* to optionally occlude and unocclude a respective opening of each of closeable compartments 206*a*-206*c*. This can be achieved by having doors 209*a*-209*c* rotate about respective hinges toward and/or away from their respective closeable compartments 206*a*-206*c*. Those skilled in the art that the hinges can be a variety of mechanical hinges. Three closeable compartments 206*a*-206*c* of bottom serving portion 204, are similar to compartments 106*a*-106*c* in that they are separated by three partitions, similar to partitions 136*a*-136*c*. Each partition extends toward an outer perimeter 224 of bottom serving portion 204 from a common central location. It is contemplated that in order to encourage and incentivize children to eat their food, a user of plate system 200 can use bottom serving portion 204 as a 'treasure chest' similar to the 'treasure chest' describe above with respect to system 100. The doors 209*a*-209*c* similar function to limit and/or resist unauthorized access to the compartments 206*a*-206*c* of the 'treasure chest'.

With continued reference to FIG. 4, a locking mechanism 210, the same or similar to locking mechanism 110, adds further security to resist unauthorized access. Locking mechanism 210 is mounted to bottom serving portion 210 at a junction of the three partitions, similar to locking mechanism 110. Locking mechanism 210 includes three spaced apart arms 212*a*-212*c*. Doors 209*a*-209*c* includes a downwardly extending tabs 213*a*-213*c* having respective apertures, similar to apertures 114*a*-114*c*. Each arm 212*a*-212*c* mates with a respective aperture on a respective one of three doors 209*a*-209*c* to lock doors 209*a*-209*c* to their respective closeable compartments 206*a*-206*c*. System 200 also includes a key with a magnet portion that can be the same as or similar to key 116 and magnet portion 118 described above. The key of system 200 can rotate arms 212*a*-212*c*, as needed, to unlock/lock the doors. It is also contemplated that system 200 can be used in a kit, similar to the kit described above.

The methods and systems of the present invention, as described above and shown in the drawings, provide for food serving systems with superior properties. While the apparatus and methods of the subject invention have been shown and described with reference to preferred embodiments, those skilled in the art will readily appreciate that changes and/or modifications may be made thereto without departing from the spirit and scope of the subject invention.

What is claimed is:

1. A food serving system comprising:

a top serving portion;

a bottom serving portion removably nested under the top serving portion, wherein the bottom serving portion includes a closeable compartment with a door operatively connected to the closeable compartment to optionally occlude and unocclude an opening of the closeable compartment; and a locking mechanism mounted to the bottom serving portion to retain the door on the compartment opening, wherein the locking mechanism includes an arm, wherein the arm mates with an aperture on the door to lock the door to the closeable compartment, wherein the locking mechanism includes a rotatable column with a locking aperture defined therein, wherein the arm extends radially outward from a periphery of the rotatable column for common rotation therewith.

2. The food serving system as recited in claim 1, wherein the door includes a downwardly extending tab having an aperture.

3. The food serving system as recited in claim 1, wherein the top serving portion includes a sidewall defining a perimeter of the top serving portion.

4. The food serving system as recited in claim 3, wherein the top serving portion includes a top compartment defined within the sidewall, wherein the top compartment has an opening and a floor surface opposite from the opening, wherein the floor surface is recessed with respect to a top edge of the sidewall.

5. The food serving system as recited in claim 4, wherein the sidewall extends in a downward direction from the top edge such that a height of the sidewall is greater than a depth of the top compartment.

6. The food serving system as recited in claim 5, wherein the compartment opening of the closeable compartment faces the bottom of the top serving portion when nested therein.

7. The food serving system as recited in claim 1, wherein the door includes an indent to provide assistance to a user to open the door.

8. The food serving system as recited in claim 1, wherein the closeable compartment of the bottom serving portion is one of a plurality of closeable compartments.

9. The food serving system as recited in claim 8, wherein the door is one of a plurality of doors, wherein each of the plurality of doors is operatively connected to a respective one of the plurality of closeable compartments.

10. The food serving system as recited in claim 1, wherein the closeable compartment of the bottom serving portion is one of three closeable compartments.

11. The food serving system as recited in claim 10, wherein the three closeable compartments of the bottom serving portion are separated by three partitions, wherein each partition extends toward an outer perimeter of the bottom serving portion from a common central location.

12. The food serving system as recited in claim 11, wherein the door is one of three doors, wherein a locking mechanism is mounted to the bottom serving portion at a junction of the three partitions, wherein the locking mechanism includes three spaced apart arms, wherein each arm mates with a respective aperture on a respective one of the three doors to lock the door to the closeable compartment.

13. A food serving system comprising:

a top serving portion;

a bottom serving portion removably nested under the top serving portion, wherein the bottom serving portion includes a closeable compartment with a door operatively connected to the closeable compartment to optionally occlude and unocclude an opening of the closeable compartment;

a locking mechanism mounted to the bottom serving portion to retain the door on the compartment opening, wherein the locking mechanism includes an arm, wherein the arm mates with an aperture on the door to lock the door to the closeable compartment; and a key configured and adapted to rotate the arm to release or engage the arm with the aperture on the door.

14. The food serving system as recited in claim 13, wherein the locking mechanism includes a rotatable column with a locking aperture defined therein, wherein the arm extends radially outward from a periphery of the rotatable column for common rotation therewith.

15. The food serving system as recited in claim 13, wherein the key includes a magnet portion.

16. The food serving system as recited in claim 15, wherein the magnet portion on the key is configured and adapted to magnetically couple with a portion of the arm through a thickness of the door.

17. The food serving system as recited in claim 13, wherein the door includes a downwardly extending tab having an aperture.

18. The food serving system as recited in claim 13, wherein the top serving portion includes a sidewall defining a perimeter of the top serving portion.

19. The food serving system as recited in claim 18, wherein the top serving portion includes a top compartment defined within the sidewall, wherein the top compartment has an opening and a floor surface opposite from the opening, wherein the floor surface is recessed with respect to a top edge of the sidewall.

20. A food serving system comprising:

a top serving portion; and a bottom serving portion removably nested under the top serving portion, wherein the bottom serving portion includes a closeable compartment with a door operatively connected to the closeable compartment to optionally occlude and unocclude an opening of the closeable compartment, wherein the closeable compartment of the bottom serving portion is one of three closeable compartments, wherein the three closeable compartments of the bottom serving portion are separated by three partitions, wherein each partition extends toward an outer perimeter of the bottom serving portion from a common central location, wherein the door is one of three doors, wherein a locking mechanism is mounted to the bottom serving portion at a junction of the three partitions, wherein the locking mechanism includes three spaced apart arms, wherein each arm mates with a respective aperture on a respective one of the three doors to lock the door to the closeable compartment.

* * * * *